United States Patent [19]

Stewart

[11] 4,142,928

[45] Mar. 6, 1979

[54] METHOD AND APPARATUS FOR THE PRODUCTION OF EXPLOSIVE SLURRY

[75] Inventor: Iain G. H. Stewart, Zug, Switzerland

[73] Assignee: Niepmann AG, Walchwil, Switzerland

[21] Appl. No.: 759,117

[22] Filed: Jan. 13, 1977

[30] Foreign Application Priority Data

Jan. 27, 1976 [DE] Fed. Rep. of Germany ..... 2602924

[51] Int. Cl.[2] ..... C06B 21/00

[52] U.S. Cl. ..... 149/109.6; 264/3 R; 264/3 E; 86/1 R

[58] Field of Search ..... 264/3 R, 3 E; 252/301.15; 149/109.6; 86/1 R

[56] References Cited

U.S. PATENT DOCUMENTS

| | | | |
|---|---|---|---|
| 3,022,149 | 2/1962 | Cramer | 264/3 R |
| 3,193,991 | 7/1965 | Browning et al. | 264/3 R X |
| 3,764,641 | 10/1973 | Ash | 264/3 R X |
| 3,800,012 | 3/1974 | Hiorth | 264/3 R |
| 3,810,425 | 5/1974 | Post | 264/3 R X |
| 3,890,877 | 6/1975 | Lista et al. | 264/3 R X |
| 3,943,820 | 3/1976 | Persson | 264/3 R X |

*Primary Examiner*—Peter A. Nelson
*Attorney, Agent, or Firm*—Martin A. Farber

[57] ABSTRACT

A method and apparatus for the production of explosive slurry composed of liquids containing fuels and oxidizing agent and under circumstances solid constituents and sensitizers, the state of aggregation of the slurry being controlled by the addition of thickening agents. The liquids are charge-wise mixed with the fuel and/or oxidizing agents, gelling agents and other constituents known in the art. From this batch or batches the product is then formed into a continuous, metered material flow into which a crosslinking agent is injected at a continuous and precisely controlled rate. Provision is also made for continuously and precisely injecting gassing and sensitizing agents. The crosslinking agent, and other agents if used, is/are uniformly distributed in a connecting, subsequent continuous mixing process before the stiffening material flow is fed to a continously operating cartridging machine after a thickening time which is controllable corresponding to the viscosity requirements of the cartridging process.

9 Claims, 3 Drawing Figures

METHOD AND APPARATUS FOR THE PRODUCTION OF EXPLOSIVE SLURRY

The invention relates to a method for the production of explosives slurry composed of liquids containing fuels and oxidizing agents and under circumstances solid constituents, the state of aggregation of the explosives slurry being variable by the addition of thickening and crosslinking agents and which is fed for cartridging to a cartridging machine, as well as an apparatus for carrying out this method.

In addition to the traditional nitroglycerine-explosives, for some time and in increasing measure, so-called "slurries" are employed as explosives. The known slurries, which are designated as "explosives slurry" are saturated aqueous solutions of ammonium nitrate and/or other nitrates with a solid excess of nitrates which are oxidizing agents, whereby this dispersion is mixed with suitable fuels as the energy carrier. The aqueous solution can furthermore be mixed with "sensitizers". The latter are sensitizing additives with which the ignition quality or cetane number of the explosive slurry is raised. The aqueous solution is gelled by the addition of thickening agents, for example starch and guar gum and cross linked with the aid of cross-linking agents, so that an increase of the viscosity is provided in the desired range, without changing the colloidal condition. Gelling and crosslinking are required in order to prevent the leaching or settling of the solid components and to make the explosives slurry water-resistant. Beyond that it is advantageous for the cartridging of the slurry. For production of the explosives slurry of the previously described type a continuous mixing process is known as well as a process by which all substances are batch-wise mixed before the finished explosive slurry is fed to the packing machine. The known continuous mixing methods possess the disadvantage that specially and constructively expensive packing machines must be employed for the nearly aqueous explosive slurry, which must be cartridged in water tight film in hose form. Moreover the control devices for the precise feed of the individual substances and for the control of the mixing processes are very expensive. The method is therefore inefficient on a cost basis and requires extensive quality control to ensure product reliability.

The known methods with batch mixing of the individual substances or components have in particular the disadvantage that the viscosity of the slurry changes during and after removal from the mixing process, in dependency on the activation time of the crosslinking agent. The stiffening time consequently can not be optimally set or adjusted for the entire batch on the subsequent packing process. With a long gelling time, i.e. low viscosity slurry, minor process stoppages create no great problems and metering and packaging become simple providing water tight casings and water tight seals are selected. Cartridges which are not adequately sealed or filled can not be stacked, however, until the product has stiffened. Beyond that there resides the danger that the components of the explosive slurry segregate and that micro air bubbles, included in the explosive slurry for increasing the sensitivity, coalesce or migrate. By speeding up the stiffening time, the mixing process is still comparatively simple and the above problems can be reduced. Slurry metering and cartridging, owing to the increasing viscosity, require the use of higher forces and pressures however and thus entails a more expensive construction for the packing machine. Process interruptions create more serious problems.

With a short stiffening time there is no risk of segregation and cartridges can be stacked immediately. On the other hand metering and packing are strongly increased in difficulty, process interruptions may result in having to scrap the complete batch and there are problems with desensitization and non-uniform filling of cartridges.

It is therefore an object of the present invention to provide a method and an apparatus for production of explosives slurry, which avoids the disadvantages of the known standard of the art and guarantees during the entire packing process a continuous, uniform optimal consistency of the slurry, which consistency is readily adjustable to the required cartridging method such that optimum processing steps as well as simple and energy saving devices can be employed, whereby particularly the ignitable explosive quantity which is required in the production process is held to a minimum and difficulties associated with cartridging stoppages are minimized. It is another object of the present invention to aid the solution of the above-mentioned objective by the steps in which, the liquids are batch-wise mixed with the fuels and/or oxidizing agents, forming a continuous metered material flow from the batch or batches, continuously metering the cross-linking agent into the slurry, uniformly distributing the crosslinkes in the material flow in a connecting subsequent continuous mixing process before the thickening material flow is fed to the packing machine, after a thickening time which is controllable corresponding to the viscosity requirements of the packing process.

According to a further feature of the present invention, sensitizing additives can be continuously metered at a predetermined rate into the metered material flow before the continuous mixing process. For controlling the density, a foaming agent can also be metered into the material flow before the continuous mixing process.

In accordance with the present invention the orientation of hydrolized chains of thickening agent molecules is preserved in the continuous mixing process. For this purpose the continuous mixing process is attained under non-turbulent conditions by a repeated distribution of the flow into a plurality of partial flow streams and by a layering or alternation of these partial streams.

The method in accordance with the present invention possesses the advantage that the liquids can be precisely mixed in batches with the fuels, the oxidizing agents and the thickening agents, ensuring correct material ratios and process conditions with simple feeders and mixing-containers, whereby the possibility exists that the feeding and mixing can be separated and can be provided in different stages. The mixture when continuously removed from the containers maintains constant viscosity, largely independent of time, since the product contains no cross-linking agent at this stage. The second component of the thickening process (cross-linking agent) is added together with gassing and, if required, sensitizing additives to the continuous material flow before a continuous mixing operation so that also during this continuous mixing operation the material flow remains sufficiently fluid to achieve a good thorough mixing therethrough. By this continuous mixing process the stiffening of the material flow occurs, which is adjusted by varying the crosslinker content and post mixing residence time to the required packing process and the type of packing. The slurry can be continuously fed in one extreme case to a connected cartridging machine in a slab of controlled cross sectional area and stiff consistency and, in another extreme case in fluid form, whereby the crosslinking time in this case is calculated such that after the filling of the slurry in the packing a strong increase of the viscosity takes place, such that the filled packings are stackable without delay. In this manner and under all conditions, good filling of the packings is guaranteed and insured. Additionally, gas bubbles remain dispersed, nor does segregation or separation of the mixture into component parts occur. By the type of continuous mixing operation in accordance with the present invention the orientation of the molecular chains of the gelling agents is preserved and dangerous sensitizing substances can be added to the material flow in small quantities only shortly before packing. In this manner the danger is strongly reduced and only small amounts of product have to be scrapped when there are interruptions in the production process.

By one use of the method in accordance with the present invention for production of slurry comprising concentrated aqueous solutions of ammonium nitrate other nitrates, fuel and thickening agents, the cohesive structure of which explosive slurry is changeable by the addition of cross-linking agents and fed for packing to a packing machine, the invention resides in the steps of batch-wise mixing the nitrate solution with the excess nitrate quantities, gelling agents and the fuel, forming a continuous, metered material flow from the mixture continuously adding to the metered material flow at a predetermined rate the cross-linking agent as well as, under circumstances, the sensitizing additives and foaming agent, which are distributed uniformly in the material flow in a subsequent continuous mixing process before the stiffening material flow is continuously fed to the packing machine during a residence time corresponding to the viscosity requirements of the packing process. The device in accordance with the present invention for carrying out of the method, which is provided with a container for the product and with supply containers for the cross-linking and other modifying agents, characterized by the product container being connected with a controllable metering pump for the production of the uniform material flow, to which a manifold is connected, with a number of tube connections corresponding to the number of cross-linking- and admixture- substances, to which said manifold a continuously working flow-through mixer is connected following thereon.

This flow-through mixer according to a further feature of the present invention, constitutes a static mixer. Each supply container, in accordance with the present invention is connected via a metering pump and a quantity meter or device to a tube connection of the manifold whereby before the tube connection a directional control valve can be arranged, which is connected to the supply container via a return conduit.

In accordance with the proposal of the present invention there is provided a constructively simple and positive operating device, which according to a further feature of the present invention can be further formed such that between the product container and the metering pump, a volumetric or gravimetric metering feeder for solid admixture substances is arranged.

The length of the flow-through mixer and of the feed tube between the mixer and cartridging machine is adjusted or set to the necessary stiffening time with consideration to the speed of material flow, in order to deliver the slurry to the packing machine with optimum and constant-remaining viscosity.

According to a further feature of the invention, two product containers can be arranged, one of which contains a fluid premixture with oxidizing character (oxygen excess) and the second contains a fluid premixture with fuel character.

Altogether the method in accordance with the present invention as well as the apparatus in accordance with the present invention has the advantage that the explosive slurry produced with it can be fed to a packing cartridging machine and packed in any packing machine in any packings and under optimum conditions or proportions, whereby the composition of the explosive slurry may be freely selected. It is thus possible to use over-wrapping machines to which the explosive slurry is fed in solidified or semi-plastic condition as a slab with rectangular cross-section, dosing machines for preformed casings or shells which are filled with liquid to thick liquid (viscous) slurry, or form-fill-seal machines to which the explosive slurry is fed in liquid condition all such machines herein constituting cartridging machines. The method in accordance with the present invention and apparatus in accordance with the present invention for the production of explosive slurry remains unchanged, independent of the subsequently connected packing machine.

With the above and other objects and advantages in view, the present invention will become more clearly understood in connection with the following detailed description of a preferred embodiment, when considered with the accompanying drawings, of which:

Figure 1:
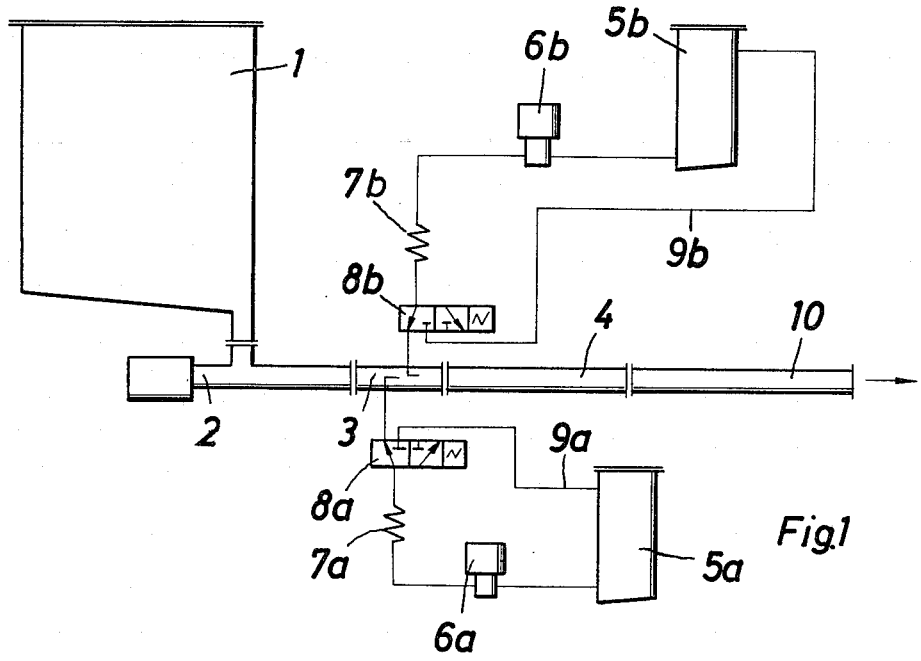
FIG. 1 is a schematic view of the device in accordance with the present invention.

Referring now to the drawings, the apparatus for production of explosive slurry according to FIG. 1 comprises a container 1, which contains the product which comprise fuels, oxidizing agents, starches natural or synthetic gums as thickening components, pH-value stabilizers and substances increasing the solubility of nitrates, for example a concentrated, aqueous solution of ammonium nitrate with nitrate quantities going beyond or supersaturating the solubility, sodium nitrate thio-urea guar gums, sulfamic acid and fuels. Fuels, which can be used are, for example, urea, sugar, hydrocarbon compounds, alcohol, ether, epoxide, various nitrogen compounds as, for example amine, amide and organic nitric acid compounds with negative oxygen balance as well as metals, such as for example aluminum powder and powder of aluminum-magnesium alloys. The following can serve as oxidizing agents in addition to the above-mentioned solutions of ammonium- or metal- nitrates. Non-metallic nitrates such as the nitrate of hydroxylammonium ($NH_3OHNO_3$), of hydrazine ($N_2H_5NO_3$), certain constituents of the nitric acid- ester, chlorate and perchlorate, such as $NaClO_4$, $NH_4ClO_4$, $ClO_4NO$, $ClO_4NO_2$.

The liquids and under circumstances solid components are mixed batch-wise in predetermined proportions in the container 1 or completely as well as partially in additional containers which are not illustrated in the drawing. In the latter case the finished mixture is subsequently transferred to the container 1.

By a metering pump 2 which is connected to the container 1, the contents of the container 1 are fed in a continuous stream to the manifold 3. By means of manifold 3, there are injected continuously to the metered material flow, a cross-linking agent as well as a foaming agent, which are distributed uniformly in the material flow by a connecting flow-through mixer 4.

In the embodiment according to FIG. 1, a container 5*a* is provided for a cross-linking agent, for example a solution of sodium dichromate. This solution is fed via a metering pump 6*a* and quantity measuring device or meter 7*a* to a directional control valve 8*a*. From this directional control valve 8*a*, a tube connection leads into the manifold 3, so that cross-linking agent at a predetermined and constant rate is injected into the continuous material flow. By switching the directional control valve 8*a*, the feed to the manifold 3 can be interrupted and the agent can be recirculated to the container 5*a* through a return conduit 9*a*. In addition to the container 5*a* for a cross-linking agent, a container 5*b* is provided, which likewise is connected to the manifold 3 via a metering pump 6*b*, a measuring device or meter 7*b*, a directional control valve 8*b* and a tube connection, and with a return conduit 9*b* provided between the directional control valve 8*b* and the container 5*b*. In this container 5*b* there is provided a foaming agent, for example a solution of sodium nitrite, which upon mixing with the material flow leads to the formation of gas bubbles.

Also, besides the supply containers 5*a* and 5*b*, an additional supply container 5*c* can be provided, which likewise is connected to the manifold 3 via a metering pump 6*c*, a measurement device or meter 7*c*, a directional control valve 8*c*, and a tube connection, whereby between the directional control valve 8*c* and the container 5*c*, a return conduit 9*c* is provided. In this supply container there is provided sensitizing additives solution, which increases the ignition quality or cetone number of the explosives slurry. Such types of sensitizing additives for example are as follows:

Esters of nitric acid which are characterized by the presence of a reaction- group $CO-NO_2$.

The mononitrate or mixtures of the same, such as for example methylnitrate $CH_3ONO_2$, ethylnitrate $C_2H_5ONO_2$, propyl- or isopropylnitrate $C_3H_7ONO_2$.

The polynitrate or mixtures of the same or mixtures from mononitrates and polynitrates.

Organic nitric acid compounds or mixtures of the same, characterized by the presence of one or more $NO_2$ groups, which are connected directly with the carbon (nitroparafin, aromatic nitric acid compounds) or with the nitrogen (nitroamine).

The nitrate of amines, such as for example the nitrate of the monomethylamines ($CH_2—NH_2HNO_3$), the dinitrate of the ethylenediamines or mixtures of these constituents.

The sensitizer in this case must be a liquid or be formed into an emulsion or suspension.

The above mentioned cross-linking agent and foaming- agent as well as the sensitizing additives are uniformly and homogeneously distributed in the material flow by the flow-through mixer 4, which preferably is a static mixer (i.e., providing non-turbulent mixing). During the continuous mixing process, the orienting of the molecular chains of gelling agents in the material flow is preserved; this is achieved preferably by the non-turbulent mixing, by a repeated distribution or splitting of the flow into many partial streams and by a continuous redistributing or alternating of these partial streams By injecting the crosslinker at the inlet of the flow-through mixer 4, there already occurs in the flow-through mixer 4 the beginning of a stiffening process. By a feed tube 10 which is connected in series to the flow-through mixer 4, the thickening material stream is continuously fed to the packing or cartridging machine after a residence time corresponding to the viscosity requirements of the process. For this purpose the diameter and/or the length of the feed tube 10 can be formed or executed differently. Moreover it is possible to adjust or set the length of the feed tube 10 by addition or removal of tube pieces in accordance with the respective circumstances from time to time. The cartridging machine is connected to the feed tube 10 and is not illustrated in the drawing.

The previously described method enables batch mixed product to be stored, without impairment or change in viscosity for a useful period of time. The product is withdrawn from the container 1, by means of the metering pump 2 in a continuous and controlled material flow without change of viscosity. Stiffening of this material flow takes place only after addition of the crosslinker in the flow-through mixer 4 and in the feed tube 10 so that the explosive slurry is fed with desired, increased viscosity to a subsequently connected packing machine. By the continuous adding of cross-linking agents in the manifold 3 it is possible to process successive batches of the basic substances without change of viscosity between the processing the first and the last partial quantities of the contents from the container 1. The viscosity of the material flow increases first in the range between its entrance into the flow-through mixer 4 and the outlet from the feed tube 10, whereby, however, it is guaranteed that during the exit from the feed tube 10, there always is attained a stiffness which is constant throughout the entire production period. By delaying addition of the sensitizing additives, which make the explosive slurry dangerous under certain circumstances, until just before the flow-through mixer 4, it is possible to limit the quantity of explosive materials in the production process to a minimum.

Figure 2:
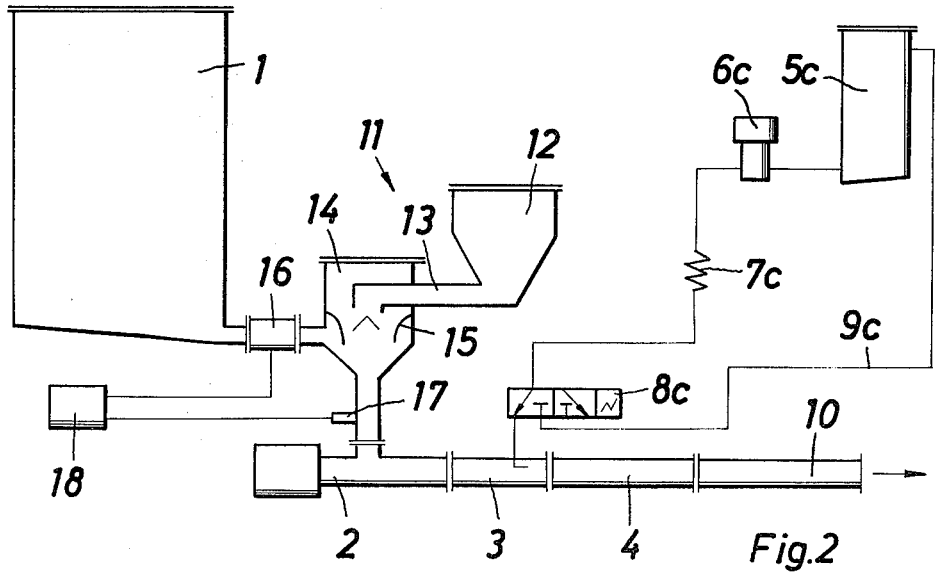
FIG. 2 is a schematic view of a second embodiment of the present invention.

In accordance with the embodiment of FIG. 2, the crosslinking agent is located in a supply container 5*c*, which in agreement with the execution of the first embodiment is connected via a metering pump 6*c*, a quantity meter or device 7*c* and a directional control valve 8*c* to the manifold 3. The directional control valve 8*c* is additionally connected with a return conduit 9*c*. Between the container 1 and metering pump 2 there is arranged a metering feeder 11, which works volumetrically or gravimetrically, for solid addition or admixture substances.

From the schematic illustration of this feeding device 11 in FIG. 2, it may be seen that this comprises a material container 12, which for example contains Guar-gum and/or starch as additional thickening means for increasing the storability and/or aluminum powder as sensitizing additive. Explosives materials such as TNT, pentaerythritol nitrate (Nitropenta) or hexaerythritol nitrate (hexogen) can be added as additional sensitizing components. These substances in the form of powders or grained materials, are metered to a mixing container 14 from the material container 12 by means of a supply tube 13, which mixing container 14 contains a supply nozzle for the dispersion which exits from the container 1. The continuous product flow from the container 1 is metered to the mixing container 14 by means of a flow controller 16. Simultaneously a level sensor 17 ensures that the necessary liquid condition which is necessary for an orderly mixing in the mixing container 14 is always properly maintained. The necessary control and regulating- processes are monitored and controlled, respectively, by a control device 18.

Evidently by the system according to FIG. 1, as well as by the system according to FIG. 2 further supply containers can be arranged, which however for better clarity of illustration have been omitted from the drawing.

Figure 3:
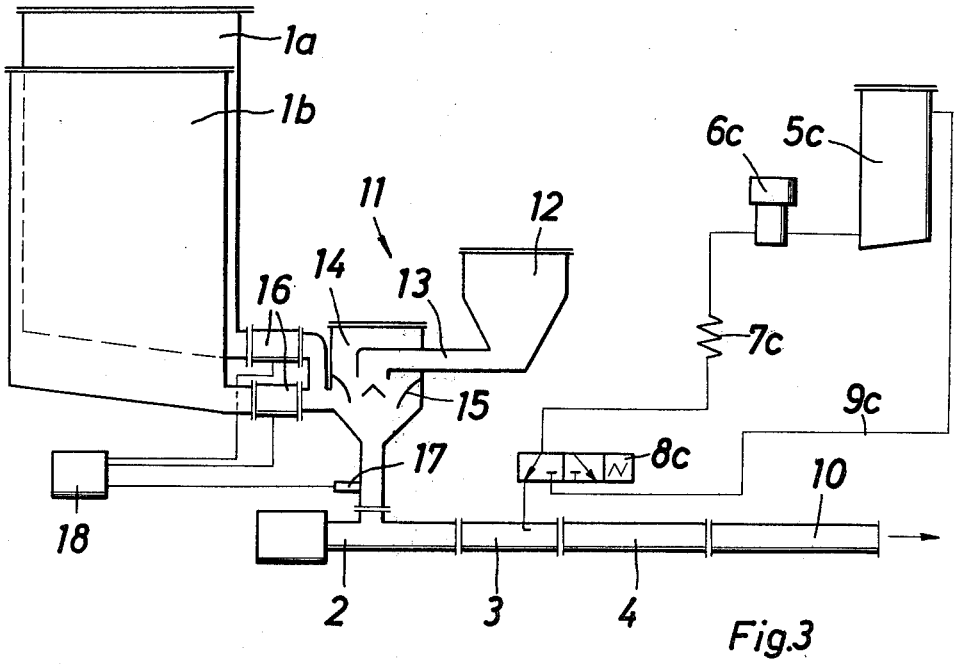
FIG. 3 is a schematic view of a third embodiment of the present invention.

In accordance with the embodiment of FIG. 3, there is provided in the supply container 1*a* the liquid with the oxidizing agents, the pH value stabilizing agent, the agent which increases the solubility and the natural or synthetic gums (first thickening components), and in the supply container 1*b* the liquid with the fuels. By means of the flow controllers 16, the liquids from both containers are metered to the mixing container 14 in a fixed ratio. All remaining elements according to FIG. 3 correspond to that of FIG. 2 and further explanation is thereby not necessary.

I claim:

1. A process for the production of slurry explosives composed of liquids containing fuels and oxidizing agents, the aggregate condition of the slurry being variable by addition of cross-linking agents, and with the slurry being fed for packing to a packing machine, comprising the steps of batch mixing liquids including water as a soluble diluent with fuels, oxidizing and gelling agents, forming a slurry, pumping the slurry through a pipe to form a continuous and constant material flow, the pumping causing a continuous metering of the material flow, continuously adding cross-linking agent at a predetermined controlled rate to the metered material flow, subsequently continuously distributing the cross-linking agent uniformly in the material flow by continuous, substantially non-turbulent mixing and automatically continuously thickening the material flow by action of the cross-linking agent for a thickening time which is controllable, corresponding to the viscosity requirements of a subsequent packing process, subsequently continuously, without accumulation, feeding the thickened material flow to a cartridging machine for packing, the pumping providing a sufficient pumping pressure to overcome the pressure drop in the pipe, the mixing and the thickening steps, and controlling the adding and metering steps to provide a constant viscosity at each stage in the operation of the process.

2. The process, as set forth in claim 1, further comprising the steps of metering a foaming agent to the material flow for density control before the continuous mixing.

3. The method, as set forth in claim 1, further comprising the step of continuously adding sensitising additives to the metered material flow at a predetermined rate immediately prior to the continuous non-turbulent mixing.

4. The process, as set forth in claim 1, further comprising the step of retaining the orientation of the hydrolised chains of thickening agent molecules in the metered material flow during the continuous mixing.

5. The process, as set forth in claim 4, wherein said continuous mixing is performed by:

repeatedly distributing the material flow into a plurality of partial streams, and alternately layering said partial streams.

6. The process, as set forth in claim 1, wherein the slurry viscosity is maintained high consistent with good pumpability.

7. The process, as set forth in claim 1, further comprising the step of controlling all steps such that the material flow stiffens rapidly after discharging onto a transfer belt of the cartridging machine to form a slab of controlled, cross-sectional area.

8. The process, as set forth in claim 1, wherein the step of feeding the thickened material flow to a cartridging machine takes place with retention of the water.

9. The process for production of slurry explosives comprising concentrated solutions of ammonium nitrate, with supersaturated nitrate quantitites, fuels and gelling agents, the stiffness of which explosive slurry is increased by the addition of cross-linking agents, and with the slurry being fed for packing on a packing machine, comprising the steps of batch-wise mixing a nitrate solution including water as a soluble reactive diluent with excess nitrate quantities, fuels and gelling agents, forming a slurry, pumping the slurry through a pipe to form a continuous and constant material flow, the pumping causing a continuous metering of the material flow, continuously adding cross-linking agent as well as sensitizing additives and foaming agent to the metered material flow at predetermined controlled rates, respectively, subsequently continuously, uniformly distributing said cross-linking agent, said sensitizing additives and said foaming agent uniformly in the material flow by continuous and substantially non-turbulent mixing and automatically continuously stiffening the flow during a residence time corresponding to the viscosity requirements of a subsequent packing process, continuously, without accumulation, subsequently feeding the cross-linked material flow to a cartridging machine for packing, the pumping creating sufficient pressure to overcome the pressure drop in the pipe, the mixing and the cross-linking steps.

* * * * *